US006226995B1

(12) United States Patent
Kalempa et al.

(10) Patent No.: US 6,226,995 B1
(45) Date of Patent: May 8, 2001

(54) FROST CONTROL SYSTEM FOR A DOOR

(75) Inventors: Walenty Kalempa, Slinger; Brian Norbert Drifka, Pewaukee, both of WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 09/333,733

(22) Filed: Jun. 15, 1999

(51) Int. Cl.[7] ..... F25D 21/00

(52) U.S. Cl. ..... 62/80; 62/265; 62/275; 454/192

(58) Field of Search ..... 62/80, 82, 248, 62/255, 256, 282, 265, 275; 454/192

(56) References Cited

U.S. PATENT DOCUMENTS

| | | | | |
|---|---|---|---|---|
| 1,892,562 | | 12/1932 | Armstrong . | |
| 1,992,011 | | 2/1935 | Knight . | |
| 2,443,342 | | 6/1948 | Colvin . | |
| 2,460,469 | | 2/1949 | Rifkin et al. . | |
| 2,493,125 | | 1/1950 | Foster . | |
| 2,731,804 | | 1/1956 | Grubbs, Sr. . | |
| 2,858,408 | | 10/1958 | Barroero . | |
| 2,984,085 | | 5/1961 | Rainwater . | |
| 3,064,110 | | 11/1962 | Vogler . | |
| 3,135,100 | | 6/1964 | Taylor et al. . | |
| 3,190,207 | * | 6/1965 | Weisz | 454/192 X |
| 3,215,058 | * | 11/1965 | Anderson | 454/192 X |
| 3,254,503 | | 6/1966 | Rundell . | |
| 3,320,766 | | 5/1967 | King . | |
| 3,394,559 | | 7/1968 | Jones . | |
| 3,449,925 | | 6/1969 | Barroero . | |
| 3,645,191 | * | 2/1972 | Asker et al. | 454/192 |
| 3,859,502 | | 1/1975 | Heaney | 219/218 |
| 3,869,873 | | 3/1975 | Thomas | 62/275 |
| 4,074,620 | * | 2/1978 | Jansson | 454/192 X |
| 4,080,764 | | 3/1978 | Stowik et al. | 52/173 X |
| 4,127,765 | | 11/1978 | Heaney | 219/218 |
| 4,341,089 | | 7/1982 | Ibrahim et al. | 62/246 |
| 4,432,406 | | 2/1984 | Belenger et al. | 160/199 |
| 4,516,482 | | 5/1985 | Smith | 98/36 |
| 4,950,869 | | 8/1990 | Mueller | 219/218 |
| 5,025,846 | | 6/1991 | West | 160/199 |
| 5,203,175 | | 4/1993 | Farrey et al. | 62/82 |
| 5,449,885 | | 9/1995 | Vandecastele | 219/522 |
| 5,606,863 | * | 3/1997 | Kicklighter et al. | 62/248 X |

FOREIGN PATENT DOCUMENTS 2 080 379 2/1982 (GB) .

OTHER PUBLICATIONS

Goldfield, Joseph, P.E., Elements of Fan Selection for Industrial Ventilation, *Heating/Piping/Air Conditioning*, Feb., 1987, pp. 53–58.

* cited by examiner

*Primary Examiner*—Harry B. Tanner
(74) *Attorney, Agent, or Firm*—Wallenstein & Wagner, Ltd.

(57) ABSTRACT

A frost control system for preventing the accumulation of frost on components of a freezer door assembly is disclosed. The system comprises a movable door disposed between a cold space and a warm space, and a header assembly. The header assembly comprises an air mover and an air inlet adapted for drawing air from the cold space to an inlet of the air mover. A conduit is provided for conducting air from an outlet of the air mover to a region of the warm space proximate to the door, and a thermostatically-controlled heater is disposed within the conduit. The conduit includes a heated air exhaust vent. Also provided is control circuitry for managing the operation of the heater and air mover.

36 Claims, 4 Drawing Sheets

FROST CONTROL SYSTEM FOR A DOOR

DESCRIPTION

1. Technical Field

The present invention relates to prevention of frost accumulation on a freezer door using an air mover.

2. Background of the Invention

Condensation and frost accumulation on machinery and other useful apparatus is an undesirable effect in many industrial applications. Depending on the particular apparatus, frost and/or condensation may impede air flow, create an unwanted layer of insulation, accelerate rusting and fouling processes, or distort the output from measurement instruments. Frost accumulation is of special concern with respect to freezer, cooler, and refrigerator doors. Frost tends to bind and reduce spatial tolerances of the moving mechanisms of such doors, and impairs visibility of door windows. Frost also engenders the formation of ice and water on the floor area near such doors, creating a safety hazard.

In one known method for preventing frost accumulation on the warm side of freezer doors, air is taken from the warm side of the doors, passed over heating apparatus, and redistributed to the warm side to establish convection currents along the warm side surfaces of the doors. This method is not optimally designed in that the water vapor content of the warm side air is not removed during the heating process. It is well known that the process of passing air over a typical dry surface heater, such as a heater coil, is a sensible heating process which increases only the dry bulb temperature of the air. Since no moisture is added to or removed from the air during this process, the humidity ratio, dew point temperature and latent heat content of the air do not change. This process can be graphically approximated by a horizontal line on a psychrometric chart. Therefore, frost accumulation is prevented only because of the increased air velocity of the redistributed air along the surface of the doors.

The present invention is directed to a process and apparatus that take advantage of the cold side air already conditioned by the pre-existing refrigeration equipment in the freezer. In many freezer applications, the cold side air is both cooled and dehumidified such that the cold side air is drier than the warm air on the other side of the freezer doors. For many food storage lockers, this will also be true even though the refrigeration equipment maintains a desired level of humidity to reduce the rate of respiration and subsequent dessication of the stored food. Accordingly, the process and apparatus of the present invention described below act to draw air from the freezer, and heat and distribute this air across the warm side of the doors. As a result, prevention of frost accumulation is achieved not only because of increased air velocity, but also because the localized region of warm air adjacent to the warm side surface of the doors has a decreased dew point temperature.

SUMMARY OF THE INVENTION

In one embodiment of the present invention, a frost control system for preventing the accumulation of frost on components of a freezer door assembly is disclosed. The system comprises a movable door disposed between a cold space and a warm space, and a header assembly. The header assembly comprises an outer housing, an electrically powered air mover disposed within the housing, and an air inlet adapted for drawing air from the cold space to an inlet of the air mover. A conduit is provided for conducting air from an outlet of the air mover to a region of the warm space proximate to the door, and a thermostatically-controlled heater is disposed within the conduit. The conduit includes a first portion inside the header in communication with the air mover and a second portion outside the header, within the warm space, and adjacent to the door. The second portion communicates with a first heated air exhaust vent. A transition portion is connected between the first and second portions. Also provided is control circuitry for managing the operation of the heater and air mover.

In another embodiment, an air mover assembly is disclosed in combination with a frost control system comprising a movable door disposed between a cold space and a warm space, a header disposed above the door and housing the air mover assembly, and ductwork containing air heaters and adapted to direct heated air to a region of the warm space adjacent to the door. The air mover assembly comprises a blower housing having a front side, a rear side, a top side, a bottom side and two opposing transverse sides. The front side is adapted to receive air within the header drawn from the cold space, the rear, top and bottom sides are closed, and the transverse sides communicate with the ductwork. An impeller is mounted within the blower housing and has an inlet communicating with the front side. The impeller is adapted to radially discharge air from the inlet.

In another embodiment, a heated air exhaust duct section is disclosed in combination with a frost control system comprising a movable door disposed between a cold space and a warm space, a header disposed above the door and housing an air mover assembly adapted to receive air from the cold space, and duct work containing an air heater and adapted to direct air discharged from the air mover assembly to a region of the warm space adjacent to the door. The exhaust duct section includes a heated air discharge vent on an outside surface of the exhaust duct section. The exhaust duct section is removably connected to the ductwork downstream from the air heater and rotatable with respect to the ductwork. The heated air exhaust duct section may include means for adjusting a discharge area of the discharge vent. Additionally, the heated air exhaust duct section includes a band clamp for removably and rotatably attaching the exhaust duct section to the ductwork.

A method is also disclosed for preventing the accumulation of frost on a door assembly situated between a cold space and a warm space. Cold air is drawn from the cold space into a manifold and then directed into an inlet of a centrifugal blower. The cold air is discharged from the centrifugal blower into ductwork. One or more heaters disposed within the ductwork are used to heat the cold air. The heated air is discharged from a vent formed in the ductwork at a location disposed downstream from the heater and proximate to a lower region of the door assembly adjacent to the warm space, to develop convection currents of heated air flowing across a width of the door assembly and across a length of the door assembly towards an upper region of the door assembly. An exhaust vent may also be installed in the ductwork at a location proximate to windows of the door assembly to better ensure that a sufficient amount heated air flows across surface of the windows.

DETAILED DESCRIPTION OF THE INVENTION

Figure 1:
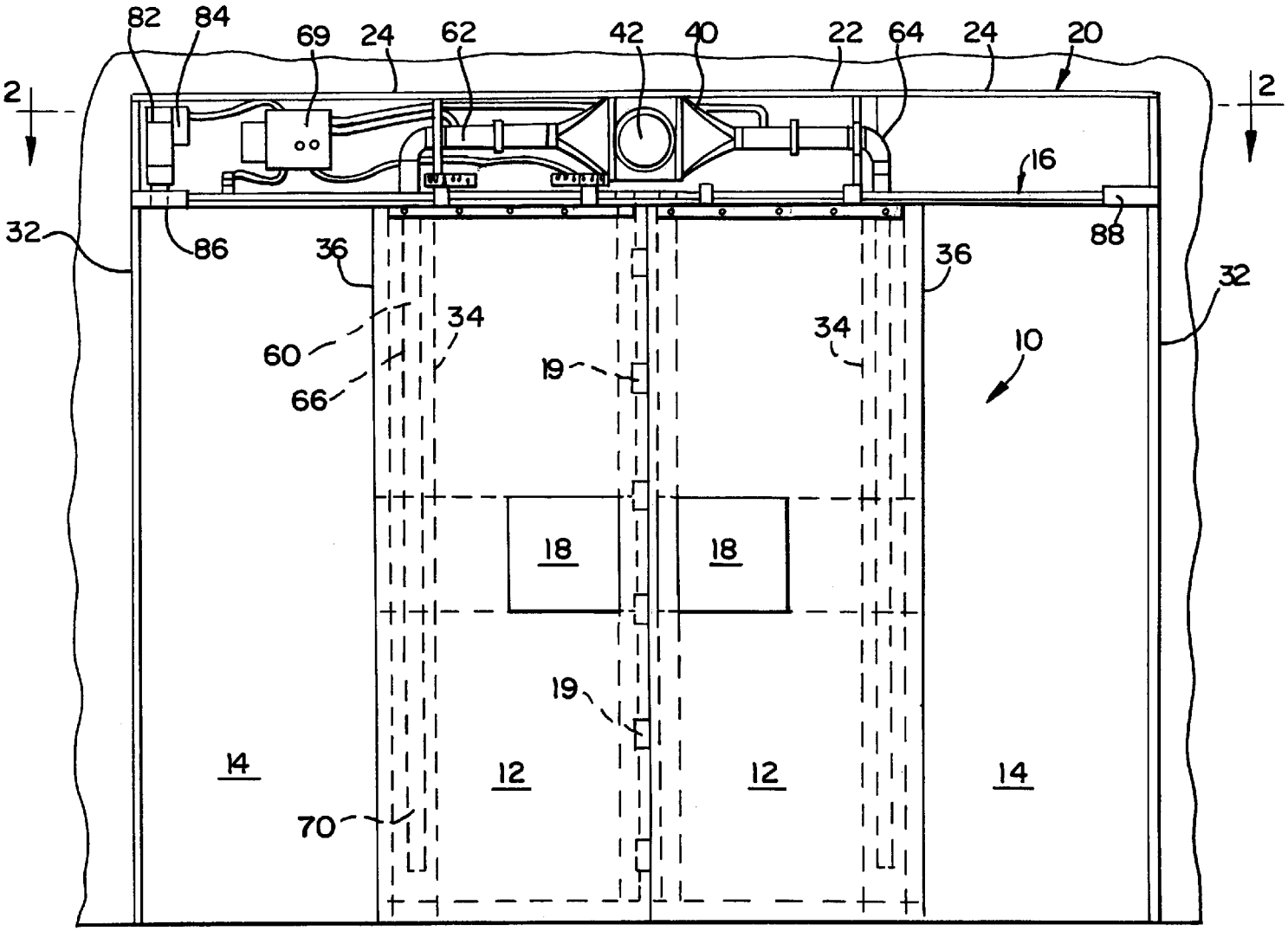
FIG. 1 is a front elevational view of a frost control system according to one embodiment of the present invention.

FIG. 1 shows a frontal view of a frost control system for a freezer or cooler door 10, as seen from the cold (i.e., freezer) side. In this particular embodiment, the door 10 is a two-panel horizontal sliding type, and is approximately 8 feet wide and 12 feet high. That is, the door 10 opens by sliding left and right door panels 12 into lateral recesses 14. The door panels 12 slide along and are supported by a guide shaft 16. In this particular embodiment the guide shaft 16 is 10 feet long. The door panels 12 may include windows 18. Magnets 19 may be provided to secure the door panels 12 when the door 10 is closed.

A header 20 is preferably located above the door panels 12. The header 20 comprises a center section 22 and two adjacent end sections 24. The end sections 24 each are about 62½ inches long, and the center section 22 is about 103 inches long. The height of each section 22, 24 is about 23½ inches, and the width is about 12 inches. The header 20 is supported by side posts 32, front vertical supports 34, and rear vertical supports 36. Each front vertical support 34 includes a 1×2 inch tube, about 12 feet in height, welded between upper and lower mounting plates. Each rear vertical support 36 includes upper and lower mounting plates welded to a 2×4 inch tube about 12 feet in height.

Figure 2:
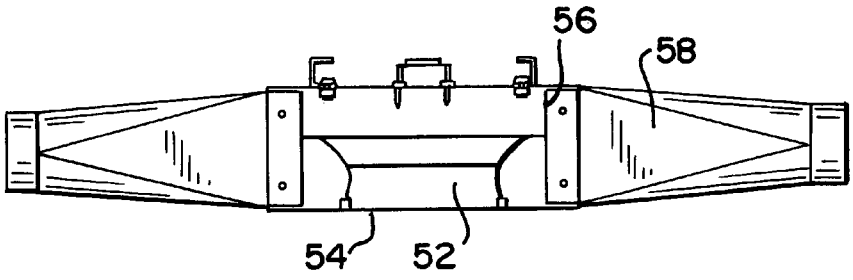
FIG. 2 is a top view of an air mover assembly according to one embodiment of the present invention.
Figure 3:
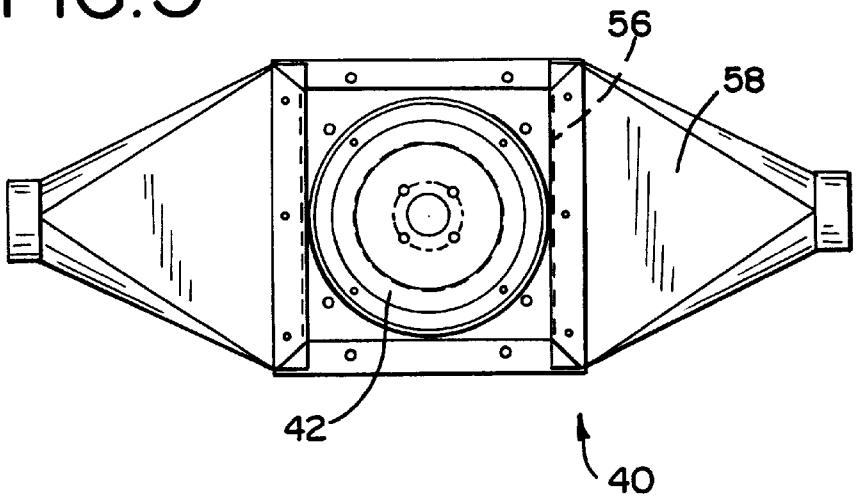
FIG. 3 is a front elevational view of the air mover assembly of FIG. 2.
Figure 4:
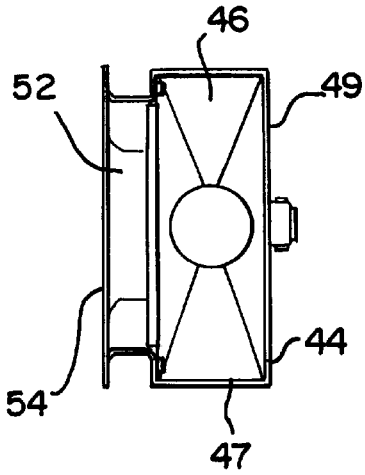
FIG. 4 is a side elevational view of the air mover assembly of FIG. 2.

The header 20 contains an air mover assembly 40. The air mover assembly 40 includes a blower 42, and preferably a centrifugal blower using a backward-curve impeller. An example of a suitable backward-curve type, centrifugal blower is Part No. RH31M-4/104370, available from ebm Industries, Inc., Hyde Road, Farmington, Conn. 06034. FIGS. 2, 3 and 4 illustrate further details regarding the air mover assembly 40. The blower 42 is encased in a blower housing 44 that is closed at the top, bottom and rear sides 46, 47, 49. A flanged inlet ring 52 is attached to the intake side 54 of the blower 42. The intake side 54 of the blower 42 housing is open to permit cold air drawn into the header 20 from the cold space to flow into the inlet ring 52. The lateral sides 56 of the blower housing 44 are open to communicate with transition ducts 58. By this configuration, all air radially discharged from the blower 42 flows only into the transition ducts 58 with minimal loss.

The transition ducts 58 on either side of the air mover assembly 40 communicate with ductwork 60. The ductwork 60 is preferably sectioned as shown in FIG. 1, and includes horizontal duct sections 62, elbow transitions 64, and vertical duct sections 66. The ductwork 60 preferably has an inside diameter of about 4 inches. The horizontal duct sections 62 contain electrical resistance heaters (not shown) to heat air passing therethrough. Temperature sensors (not shown) are provided at locations proximate to the heaters in order to send heated air temperature measurement signals to appropriate electronic control circuitry, which may be housed in a control box 69 inside or outside the header 20. The control circuitry is adapted by known means for cycling current to the heaters in response to the heated air temperature measurement signals, and in comparison to a desired temperature range defined by high and low set points. To prevent the heaters from becoming or remaining energized when the blower 42 is not moving air and/or when the door panels 12 are open, switches for the heaters, blower 42 and door panels 12 may be connected in series. The ductwork 60 terminates in a exhaust section 70 containing a heated air exhaust vent 72 (see FIG. 9).

The header 20 also contains an electric motor 82 and ac drive 84 for operating the door panels 12. An appropriate system of pulleys and one or more belts are provided for this purpose. For example, a drive pulley 86 may be disposed on a drive shaft of the motor 82 and an idler pulley 88 may be disposed at the other side of the freezer door system near the opposite side post 32. Proximity or limit switches (not shown) may be provided for automatic operation of the door panels 12.

Figure 7:
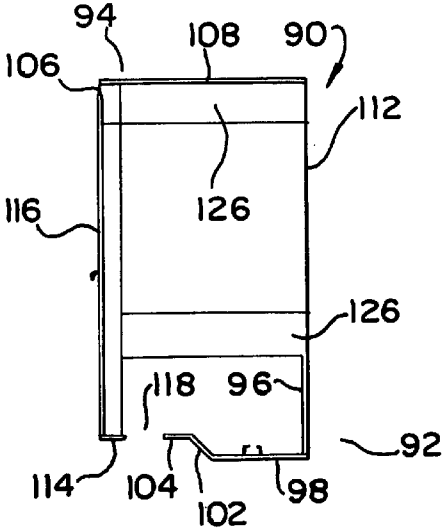
FIG. 7 is a side elevational view of the header frame of FIG. 5.
Figure 6:
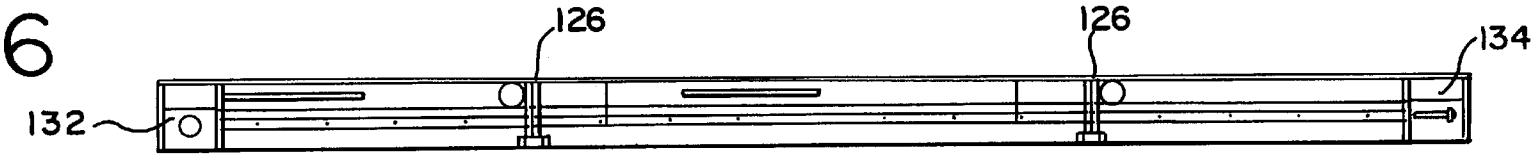
FIG. 6 is a top view of the header frame of FIG. 5.
Figure 5:
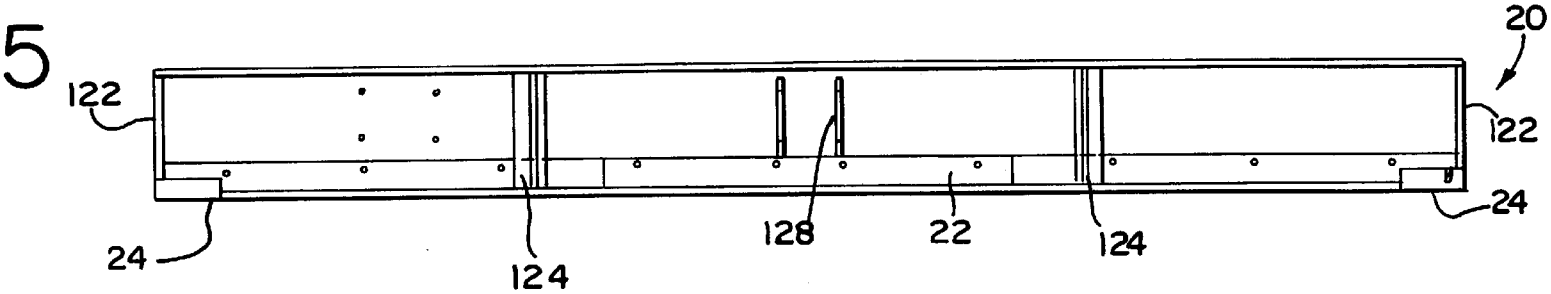
FIG. 5 is a front elevational view of a header frame according to one embodiment of the present invention.

FIGS. 5, 6 and 7 show details of the header 20 without the blower assembly 40 and ductwork 60 installed. The header 20 includes a header frame 90 that is substantially typical of each section of the header 20. The primary structural components of the header frame 90 are a main support 92 and a rear spreader 94. The main support 92 has a front portion 96, a base portion 98, an angle portion 102 and an end portion 104. The rear spreader 94 has a front portion 106, a top portion 108, a rear portion 112 and an end portion 114. Front covers 116 are fastened at the front portions 96, 106 of the main support 92 and the rear spreader 94 to close the header 20 on the cold side. A gap 118 is defined between the end portions 104, 114 of the main support 92 and rear spreader 94, and runs along the length of the header frame 90. The function of the gap 118 is described later. With respect to the end sections 24 of the header 20, the main support 92 and rear spreader 94 are securely positioned relative to each other by welding them to header side plates 122. The center section 22 of the header 20 may be joined, such as by weldments or fasteners, to the end sections via vertical support mounts 124 and brackets 126. The header 20 also includes appropriate components for mounting the motor 82 and pulleys 86, 88, as well as a blower bracket 128 for securing the blower assembly 40. For example, FIG. 6 shows a drive shaft mounting plate 132 and an idler pulley mounting plate 134.

Figure 8:
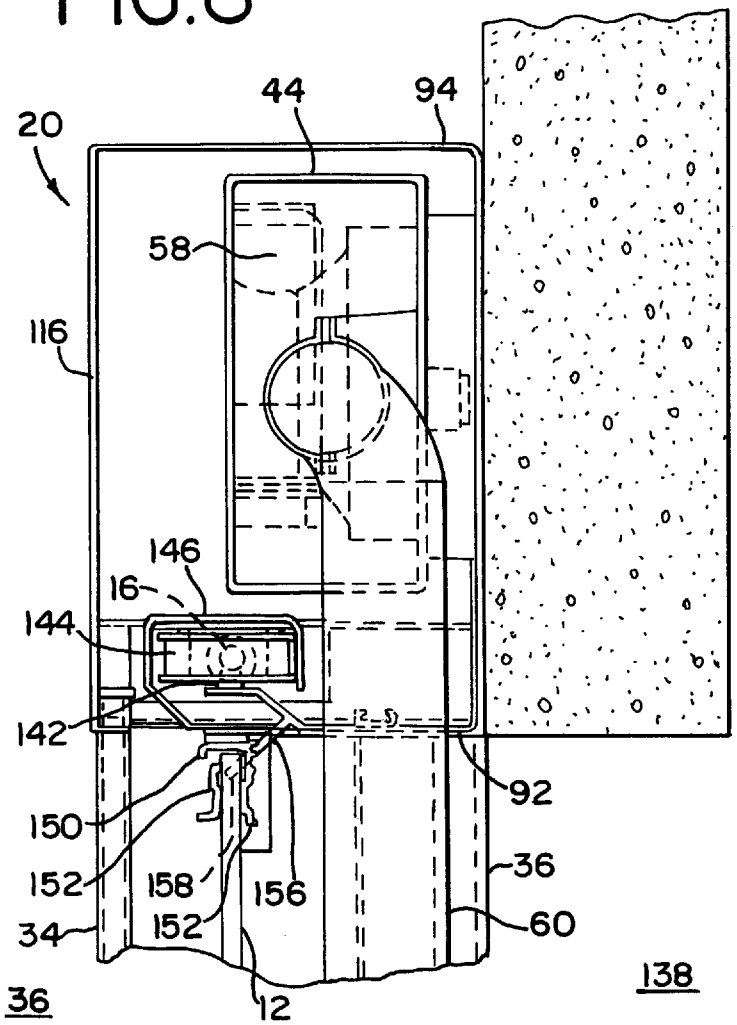
FIG. 8 is a partially cutaway side view of the frost control system of FIG. 1.

FIG. 8 is a side view of one of the end sections 24 of the header 20 with the blower assembly 40 and ductwork 60 installed. The door panels 12 serve as a boundary between a cold space 136 and a warm space 138. For the two-panel horizontal sliding door embodiment exemplified herein, several components may be employed to suspend the door panels 12 and enable the door panels 12 to slide with minimal friction. A support rail 142 is mounted to the end portion 104 of the main support 92 of each section 22, 24 of the header 20. The guide shaft 16 is in turn mounted to the support rail 142. A plurality of linear bearings 144 are slidably mounted on the guide shaft 16. A hanger 146 such as the type shown in FIG. 8 is attached to each linear bearing 144. The hanger 146 supports the door panel 12 through attachment to a door panel bracket 150, which preferably includes a panel bracket extension 152 and a panel backing plate 154. When the door panels 12 are closed and the blower 42 is placed in operation, cold air from the cold space 136 will be drawn into the header 20 through the gap 118 previously defined between the respective end portions 104, 114 of the main support 92 and rear spreader 94. By this configuration, the header 20 serves as an intake manifold for the blower 42. Leakage to or from the warm space 138 is prevented by providing a seal 156 that runs along the length of the header sections 22,24. The seal 156 depends from the angle portion 102 of the main support 92 and extends to the door panel 12. The seal 156 may further extend into a recessed portion of the door panels 12. The seal 156 may be constructed of a flexible rubber or polymeric material. Alternatively, the seal 156 may be a brush comprising an array of bristles, the rows and columns of which are packed to a density sufficient to prevent infiltration.

Figure 10:
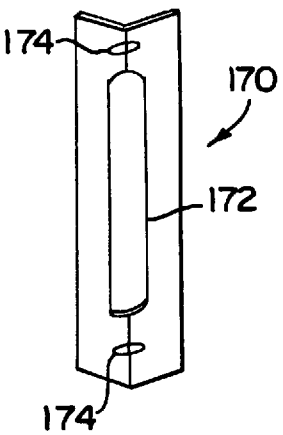
Figure 9:
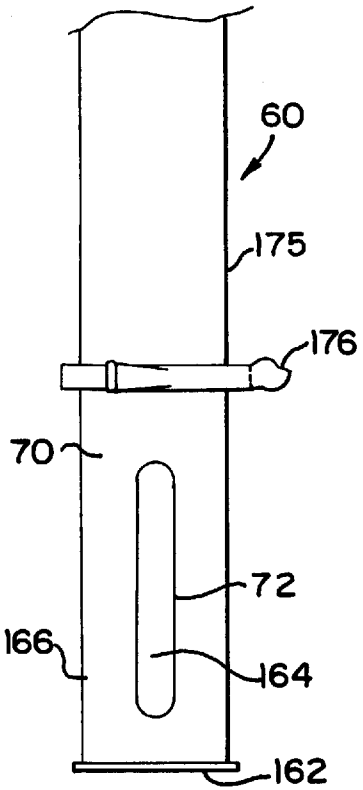
FIG. 9 is a front elevational view of an exhaust vent according to one embodiment of the present invention; and, FIG. 10 is a perspective view of an adjustment piece for the exhaust vent of FIG. 9.

FIG. 9 illustrates a lower portion of the ductwork 60 that includes the exhaust section 70. The exhaust section 70 terminates in a cap 162 such that all air discharged from the blower 42 exhausts through a heated air exhaust vent 72. The exhaust section 70 may include means for adjusting a discharge area 164 of the exhaust vent 72. An example of such means is an adjustment piece having a shape which conforms to that of the heated air exhaust section 70, rotatably mounted adjacent to an outer surface 166 of the exhaust section 70. The adjustment piece may be rotated to partially cover the exhaust vent 72. In the example shown in FIG. 10, an adjustment piece 170 has a wide-angle V-shaped cross-section. The adjustment piece 170 has a discharge slot 172 conforming to the exhaust vent 72 of the exhaust section 70, and two fastener slots 174 for use in tightening the adjustment piece 170 to the outer surface 166 of the exhaust section 70.

The exhaust section 70 is removably attached to an adjacent duct section 175 using a band clamp 176. In this manner, the exhaust section 70 may be rotatably adjusted relative to the adjacent duct section 175 in order to direct the flow of heated air at a desired angle with respect to the door panels 12. It will be noted that band clamps 176 may similarly be used to connect other duct sections for complete modularity. This is especially important with regard to vertical duct sections 66, which may become damaged by fork lifts and other vehicles. That is, a single duct section may be replaced without having to purchase and install an entire length of vertical ductwork. In addition, the horizontal duct section or sections 62 containing the heaters may be removed to inspect or replace the heaters.

While specific embodiments have been illustrated and described, numerous modifications are possible without departing from the spirit of the invention, and the scope of protection is only limited by the scope of the accompanying claims.

We claim:

1. A frost control system for preventing the accumulation of frost on components of a freezer door assembly comprising:

a movable door disposed between a cold space and a warm space;

a header assembly comprising an outer housing, an electrically powered air mover disposed within the housing, and an air inlet adapted for permitting air to be drawn from the cold space to an inlet of the air mover;

a conduit for conducting air from an outlet of the air mover to a region below the header assembly; and a thermostatically-controlled heater disposed within the conduit to heat the air after being drawn from the cold space.

2. The frost control system of claim 1 further comprising means for moving the door between open and closed positions.

3. The frost control system of claim 1 further comprising means in communication with the door in its closed position for preventing infiltration of air between the cold space and the warm space.

4. The frost control system of claim 1 wherein the door is horizontally slidable.

5. The frost control system of claim 1 wherein the door is vertically slidable.

6. The frost control system of claim 1 wherein the header is disposed above the movable door.

7. The frost control system of claim 1 wherein the region below the header assembly is proximate to the door.

8. The frost control system of claim 6 wherein the air mover is disposed in a center region of the header above the door.

9. The frost control system of claim 6 wherein the air mover is disposed in a longitudinal side region of the header.

10. The frost control system of claim 1 wherein the air mover comprises a blower.

11. The frost control system of claim 10 wherein the blower includes a backward curved impeller.

12. The frost control system of claim 1 wherein the heater is disposed in a portion of the conduit inside the header.

13. The frost control system of claim 1 wherein the heater is disposed in a portion of the conduit outside the header.

14. The frost control system of claim 1 wherein the conduit includes:

a first portion inside the header in communication with the air mover;

a second portion outside the header, within the warm space, and adjacent to the door, the second portion in communication with a first heated air exhaust vent; and, a transition portion connected between the first and second portions.

15. The frost control system of claim 14 wherein the first exhaust vent is adapted to direct heated air from the conduit to a region of the warm space proximate to the door.

16. The frost control system of claim 15 including means for adjusting an outlet area of the exhaust vent.

17. The frost control system of claim 15 including means for adjusting the direction of heated air discharging from the exhaust vent.

18. The frost control system of claim 14 further comprising a second heated air exhaust vent disposed along a section of the conduit proximate to a window of the door and adapted to direct heated air across the window.

19. The frost control system of claim 1 further comprising a temperature sensor disposed in the conduit and a control circuit, wherein the control circuit is adapted to control on/off cycling of the heater in response to a temperature measurement signal received from the temperature sensor and a set point temperature signal registered with the control circuit.

20. The frost control system of claim 1 further comprising a radiant heat source mounted proximate the door.

21. The frost control system of claim 20 wherein the radiant heat source is at least one infrared heat lamp.

22. The frost control system of claim 20 wherein the radiant heat source is mounted above the door.

23. The frost control system of claim 20 wherein the radiant heat source is mounted adjacent the door.

24. An air mover assembly in combination with a frost control system comprising a movable door disposed between a cold space and a warm space, a header disposed above the door and housing the air mover assembly, and ductwork adapted to direct air to a region of the warm space adjacent to the door, the air mover assembly comprising:

a blower housing having a front side, a rear side, a top side, a bottom side and two opposing transverse sides, wherein the front side is adapted to receive air within the header from the cold space, the rear, top and bottom sides being closed, and the transverse sides communicating with the ductwork;

an impeller mounted within the blower housing, the impeller having an inlet communicating with the front side and adapted to discharge air from the inlet; and, an air heater for heating the air before discharge from the inlet.

25. The air mover assembly of claim 24 wherein the impeller is adapted to discharge air radially from the inlet.

26. The air mover assembly of claim 24 wherein the air heaters are disposed within the ductwork.

27. The air mover assembly of claim 24 wherein the air received within the header is drawn from the cold space.

28. The air mover assembly of claim 24 wherein the impeller has a backward curved configuration.

29. An air exhaust duct section in combination with a frost control system comprising a movable door disposed between a cold space and a warm space, a header housing an air mover assembly adapted to receive air from the cold space, and ductwork adapted to direct air discharged from the air mover assembly through at least one heater disposed therein and to a region of the warm space adjacent to the door, the exhaust duct section including an air discharge vent on an outside surface of the exhaust duct section, wherein the exhaust duct section is removably connected to the ductwork and rotatable with respect to the ductwork.

30. The air exhaust duct section of claim 29 further comprising means for adjusting a discharge area of the discharge vent.

31. The air exhaust duct section of claim 29 further comprising a band clamp for removably and rotatably attaching the exhaust duct section to the ductwork.

32. The air exhaust duct section of claim 29 wherein the header is disposed above the door.

33. A method for preventing the accumulation of frost on a door assembly situated between a cold space and a warm space comprising the steps of:

drawing cold air into a manifold from the cold space;

directing the cold air into an inlet of a centrifugal blower;

discharging the cold air from the centrifugal blower into ductwork;

heating the cold air within the ductwork; and, discharging the heated air from a vent formed in the ductwork towards a side of the door adjacent to the warm space.

34. The method of claim 33 further comprising the step of discharging air from the vent at a location proximate to a lower region of the door assembly adjacent to the warm space, to develop convection currents of heated air flowing across a width of the door assembly and across a length of the door assembly towards an upper region of the door assembly.

35. The method of claim 33 further comprising the step of employing a heater disposed within the ductwork to heat the air.

36. The method of claim 35 further comprising the step of discharging air from the vent at a location disposed downstream from the heater and proximate to a lower region of the door assembly adjacent to the warm space, to develop convection currents of heated air flowing across a width of the door assembly and across a length of the door assembly towards an upper region of the door assembly.

* * * * *

UNITED STATES PATENT AND TRADEMARK OFFICE

CERTIFICATE OF CORRECTION

PATENT NO. : 6,226,995 B1
DATED : May 8, 2001
INVENTOR(S) : Walenty Kalempa and Brian Norbert Drifka It is certified that error appears in the above-identified patent and that said Letters Patent is hereby corrected as shown below:

Title page,
After Item "[22] Filed: Jun. 15, 1999", please insert:

-- Related U.S. Application Data

[60] Provisional application No. 60/090,434, Jun. 24, 1998 --

Column 1,
Line 5, insert the following paragraph:

-- This application claims the benefit of U.S. Provisional Application No. 60/090,434, filed June 24, 1998. --

Signed and Sealed this

Fifth Day of February, 2002

*Attest:*

*Attesting Officer*

JAMES E. ROGAN
*Director of the United States Patent and Trademark Office*